United States Patent [19]

Schieber

[11] 4,093,020

[45] June 6, 1978

[54] VAPOR-TYPE HEAT EXCHANGER

[75] Inventor: John R. Schieber, Holland, Pa.

[73] Assignee: Betz Laboratories, Inc., Trevose, Pa.

[21] Appl. No.: 670,787

[22] Filed: Mar. 26, 1976

[51] Int. Cl.[2] ..... F28B 5/00; F28F 21/00; G01N 25/00

[52] U.S. Cl. ..... 165/1; 73/15 R; 122/31 R; 122/32; 165/11; 165/110

[58] Field of Search ..... 165/DIG. 11, 110, 111, 165/112, 11, 1; 122/31 R, 32; 73/15 R

[56] References Cited

U.S. PATENT DOCUMENTS

| | | | |
|---|---|---|---|
| 1,620,807 | 3/1927 | Ehrhart | 165/112 |
| 2,589,733 | 3/1952 | Rosenblad | 165/111 |
| 2,621,901 | 12/1952 | Wheeler | 165/110 X |
| 3,026,043 | 3/1962 | Lacy et al. | 165/110 X |
| 3,482,625 | 12/1969 | Bray | 165/110 X |

FOREIGN PATENT DOCUMENTS

| | | | |
|---|---|---|---|
| 1,155,755 | 5/1958 | France | 165/110 |

*Primary Examiner*—Charles J. Myhre
*Assistant Examiner*—Sheldon Richter
*Attorney, Agent, or Firm*—Alexander D. Ricci; Steven H. Markowitz

[57] ABSTRACT

A vapor-type heat exchanger is disclosed in which cooling fluid conduit means are located within shell means and vapor inlet means and condensate outlet means are provided in the shell means to provide for the ingress and egress of a fluid to be cooled. By locating the vapor inlet means below the cooling fluid conduit means and the condensate outlet means above the same, it is ensured that the cooling fluid conduit means will be submersed in liquid.

23 Claims, 4 Drawing Figures

VAPOR-TYPE HEAT EXCHANGER

DESCRIPTION OF INVENTION

The present invention relates generally to heat exchangers. The present invention is particularly useful as it relates to vapor-type test heat exchangers used in evaluating process heat exchange systems. Vapor-type heat exchangers are those which use vapor as a heat exchange fluid.

Indeed, test heat exchangers find many uses in industry. For example, corrosion and fouling tendencies on process heat exchanger heat transfer surfaces can be evaluated. Also, changes in heat transfer efficiencies of process heat exchanger heat transfer surfaces can be evaluated.

To obtain a suitable evaluation, the test heat exchanger should be operated as nearly as possible under conditions simulating the process heat exchanger being investigated. Accordingly, the process cooling fluid and the process hot fluid (fluid which is cooled) must be simulated, along with other elements of the process system as will readily occur to the artisan. Water is typically used in the test system to simulate the process cooling fluid which in many instances is cooling water. In many instances steam is utilized to simulate the hot process fluid (process fluid which is cooled), since the use of the hot process fluid actually used in the process system is almost always impractical (while steam is referred to in the present description, it should be understood that any vapor with sufficient latent heat of vaporization to simulate the process system hot fluid can be used in practicing the invention). Indeed, the hot process fluid is often highly volatile or toxic and, thus, is dangerous to handle. Furthermore, it is often very difficult to physically get to the hot process fluid flow lines to tap the same; or the cost of the plumbing necessary to tap the lines is prohibitive.

The use of steam as the hot fluid in a test heat exchanger for evaluating a process heat exchanger system has presented problems in the past. Using steam, the test system heat transfer rates were found to be higher and more severe than those in the system being evaluated. Also, controlling the system parameters (e.g. temperature and pressure) related to the steam was found to be difficult, if not virtually impossible.

Such problems related to using steam in a test heat exchanger formed the basis for the present inventive effort. Indeed, the inventive heat exchanger is seen to overcome the problems in a simple manner.

According to one feature of the present invention, steam enters the shell side and cooling fluid is used on the tube side of a vapor heat exchanger. By arranging the shell side steam inlet below the cooling fluid conduit and by further arranging a shell side condensate outlet above the cooling fluid conduit, it is ensured that the conduit will be submersed in liquid during operation of the heat exchanger. Accordingly, the heat transfer rates in the test system can be lowered to more closely simulate the heat transfer rates in the process system. Furthermore, the heat input to the system can be more closely controlled by simply adjusting the rate of condensate flow from the shell. In addition, by locating the shell side condensate outlet in the top of the shell, it is ensured that substantially the entire shell side will contain liquid.

According to another feature of the present invention, the steam inlet comprises a manifold which will further enhance the already improved control and operation of the heat exchanger. The manifold is an elongated conduit which extends within the shell. As already noted, the manifold is submersed in liquid in use. Openings provided through the wall, and preferably along the length, of the manifold are directed to provide what applicant refers to as "jet mixing action". The jet mixing action direction of the openings has two basic requirements. First, the openings should not be arranged to direct steam directly against the cooling fluid conduit. If steam is so directed against the conduit, the constant uniform heat transfer would be lost or diminished, and energy which would otherwise be utilized to impart a mixing motion to the condensate in the shell would be dissipated. Second, the openings should not be directed to impinge steam directly against the inside wall of the shell, which impingement would also dissipate mixing energy of the steam. It should presently occur to the artisan, having the benefit of the present disclosure, that the resulting jet mixing action which imparts a swirling motion to the condensate in the shell will increase the efficiency of heat transfer on the shell side, keep the temperature drop across the liquid film on the exterior of the cooling fluid conduit more constant, and keep the temperature of the discharged condensate more constant. By providing a cooling fluid conduit which is also elongated and coextensive with the above-described elongated vapor inlet manifold, the operation and control of the heat exchanger is even further enhanced. From the above it should readily occur to the artisan that while the invention is particularly useful as it relates to test heat exchangers, indeed many advantages and improvements will be realized by practicing the present invention in any vapor-type heat exchanger system.

Accordingly, it is an object of the present invention to provide an improved heat exchanger of the type which uses a vapor as a heat exchange fluid.

It is a further object of the present invention to provide a novel vapor-type heat exchanger which overcomes the drawbacks related to prior vapor-type heat exchangers by relatively simple means.

Still a further object of the present invention relates to providing an improved vapor-type heat exchanger having an arrangement which is easily incorporated in pre-existing heat exchangers.

These and other objects, features and advantages of the present invention will become more apparent from the following description when taken in connection with the accompanying drawing which shows, for purposes of illustration only, a preferred embodiment of the present invention, and wherein.

Figure 1:
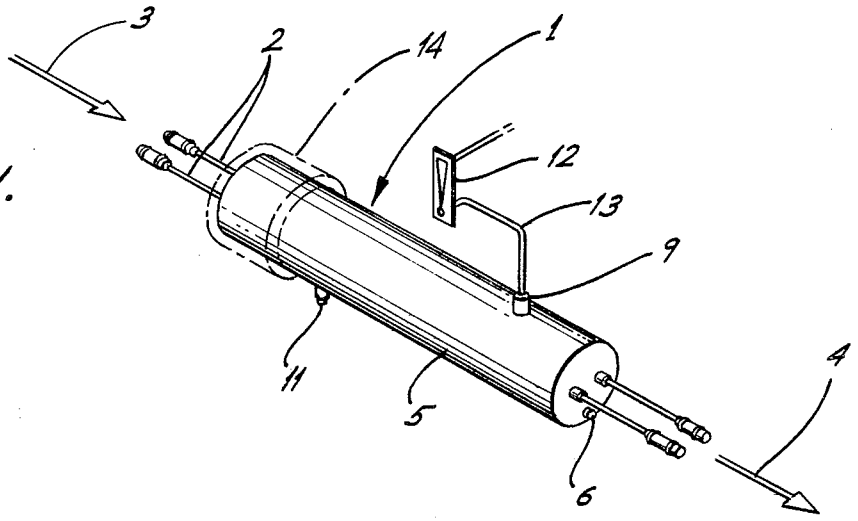
FIG. 1 is a schematic perspective view of a heat exchanger according to the present invention.
Figure 4:
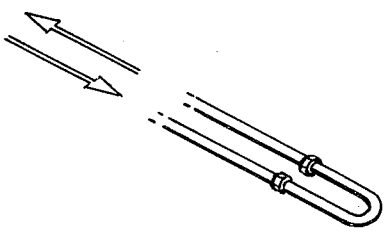
FIG. 4 is a schematic view of the cooling fluid conduit means modified for series flow.
Figure 2:
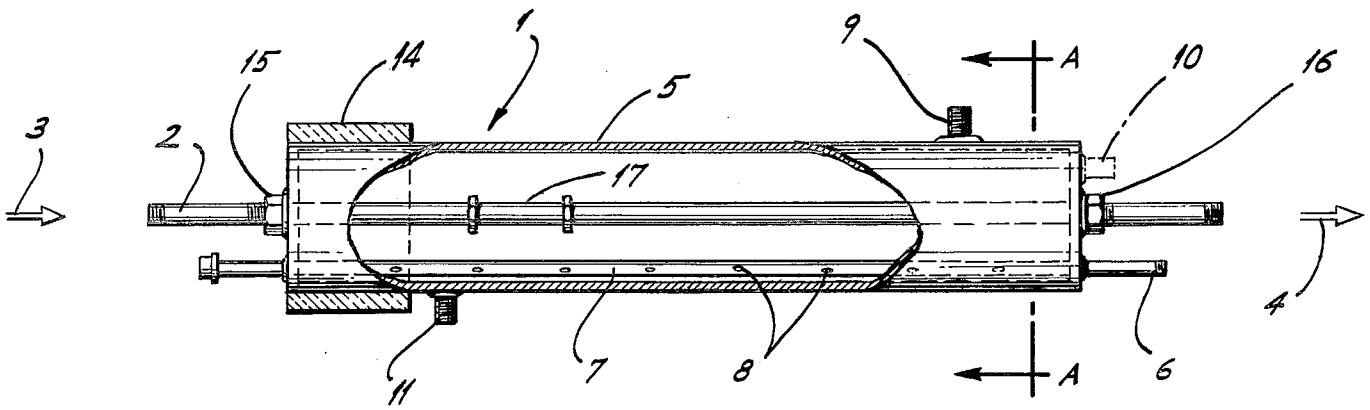
FIG. 2 is a longitudinal side view of the heat exchanger shown in FIG. 1 with a portion of the shell broken away.

Referring now to the drawing wherein like reference numerals are used throughout the various views to designate like parts, the numeral 1 generally indicates a heat exchanger according to the present invention. Element 2 refers to cooling fluid conduit means which are shown in FIG. 1 as single tubes and as being connected for parallel flow of the cooling fluid, preferably water. Of course, as shown in FIG. 4, the tubes 2 can be easily connected for series flow. In use, the cooling fluid enters tubes 2 as shown schematically by arrow 3, flows through the tubes, and leaves the same as schematically shown by arrow 4. If, for example, the heat exchanger according to the present invention is to be used to evaluate corrosion and fouling of process heat exchanger surfaces, the tubes 2 are removably held within shell 5 by screw nuts 15 and 16. As is known to those skilled in the art, the tubes 2 could include a removable test specimen 17 used to evaluate corrosion and fouling. Shell 5 is provided in surrounding relationship to tubes 2. While the illustrated shell is cylindrical, it could be of any suitable shape. Numeral 6 designates the inlet end of vapor inlet manifold 7 through which the heat exchange fluid to be cooled (hot fluid) is supplied to shell 5. The inlet manifold 7 is preferably elongated and is preferably at least of the same length as shell 5. Element 9 is a condensate outlet provided in shell 5. By locating condensate outlet 9 above tubes 2, and manifold 7 therebelow, it should now readily occur to the artisan that shell 5 will fill up with condensate up to the level of outlet 9. While outlet 9 is shown in the top of shell 5, it could be located in an end wall thereof, as at 10 in FIG. 2, as long as it is located above tubes 2. Accordingly, the tubes 2 will be submersed in liquid in use. A condensate drain 11 is provided in the bottom of shell 5 for draining condensate therefrom when the heat exchanger is not in use.

In order to control the heat input to the illustrated heat exchanger system, condensate outlet 9 is provided with a suitable valve 12 shown in FIG. 1. A rotameter, not necessary to the device, can be used to measure rate of condensate flow. As the incorporation of the illustrated valve arrangement into the condensate outlet conduit 13 is considered to be well within the knowledge and skill of the art, further details related to this matter are not included. By controlling the rate of flow of condensate from the shell, the rate of vapor input and thus heat input into the system is controlled.

Figure 3:
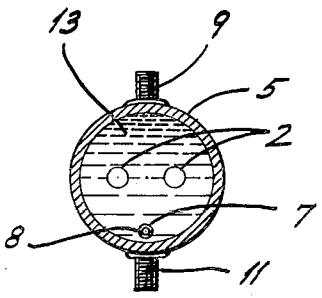
FIG. 3 is a cross-sectional view of the inventive heat exchanger taken along section A—A FIG. 2.

The openings 8 in manifold 7 are arranged along the length thereof in such a manner as to provide jet mixing action of the condensate 13 (shown in FIG. 3). The orientation of the openings with respect to the tubes 2 and the inside wall of shell 5 is important in this matter. The openings should be directed such that vapor being injected into condensate 13 will not impinge directly on tubes 2 or on the inside wall of shell 5 in such a manner as to dissipate vapor energy which would otherwise impart mixing motion to the condensate. If the openings are so directed for jet mixing action, the injected vapor will impart a swirling motion to condensate 13 to promote a uniform and constant condensate temperature and a uniform and constant heat transfer rate across the walls of tube 2.

The above-described vapor-type heat exchanger would be utilized as a test heat exchanger using steam as the hot fluid and water as the cooling fluid to evaluate corrosion and fouling tendencies on the process heat transfer surfaces of a cooling water system as follows. As already noted, the cooling fluid conduit means 2 may be connected in parallel (FIG. 1) or in series (FIG. 4). A parallel connection assures the same conditions in each tube if, for example, untreated and pretreated tubes are to be compared. A series connection requires one half as much cooling water for a given water velocity in the tubes, but the average water temperature in each tube will differ slightly. The test heat exchanger should be located at readily accessible place for ease of installation, removal of test tubes and frequent observation. The unit is mounted horizontally. The water supply can be taken from the pump discharge of the process cold well where pressure is highest. The steam supply is taken from the top of a steam line, preferably one in active use. For quantitative data, the steam supply should be free of moisture and should be held at a substantially constant pressure. The cooling fluid tubes should be the same metal as those being compared in the process heat exchanger system and the water velocity through the tubes in the test heat exchanger should be the same as that in the process heat exchanger system. The initial run normally duplicates the condition of the process system under typical conditions. Once initial results are obtained, additional runs are performed with modifications in operating procedures or in chemical treatment and controls. At the end of each run, the operator can remove the tubes, observe their condition and/or record pertinent data. During each run, typical data recorded includes flow rates, temperatures, needed adjustments, chemical controls and abnormalities in the process. In certain uses, it may be desirable to insulate the shell side 5 as partially indicated at 14.

While a preferred embodiment and modifications thereto have been shown and described in accordance with the present invention, it is understood that the same is not limited thereto but is susceptible of numerous changes and modifications as shown to those skilled in the art. Accordingly, the present invention is not limited to the details shown and described herein, but it covers all such changes and modifications as are encompassed by the scope of the appended claims.

I claim:

1. A method of exchanging thermal energy between cooling fluid and hot fluid comprising the steps of:

conducting the cooling fluid through thermally conductive conduit means surrounded by shell means, injecting the hot fluid in the vapor phase into the shell means, drawing the hot fluid from the shell means in the liquid phase, maintaining the conduit means submersed in the liquid phase of the hot fluid, and directing the vapor phase of the hot fluid into the liquid phase thereof not directly against said conduit means and not directly against said shell means to provide jet mixing the liquid phase of the hot fluid with the vapor phase thereof.

2. The method of claim 1, comprising the further step of controlling the amount of heat input from said hot fluid by controlling the amount of the liquid phase being drawn from the shell means.

3. A heat exchanger comprising:

first conduit means for conducting cooling fluid in use, shell means surrounding at least a portion of said first conduit means for conducting hot fluid in use, vapor inlet means for injecting hot fluid as vapor into said shell means, said vapor inlet means being located within said shell means and below said first conduit means in use, and condensate outlet means for draining said hot fluid as condensate from said shell means, said condensate outlet means being located in said shell means and above said first conduit means in use, whereby said first conduit means is submersed in condensate in use, wherein said vapor inlet means is an elongated manifold having vapor flow openings along its length, and wherein said openings are directed not directly against said first conduit means and not directly against said shell means for jet action mixing of condensate in said shell means in use.

4. The heat exchanger of claim 3, wherein said condensate outlet means is located in an uppermost wall portion of said shell means.

5. The heat exchanger of claim 3, wherein said condensate outlet means is located in an uppermost wall portion of said shell means.

6. A heat exchanger comprising:

first conduit means for conducting cooling fluid in use, shell means surrounding at least a portion of said first conduit means for conducting hot fluid in use, vapor inlet means for injecting hot fluid into said shell means, said vapor inlet means being located within said shell means and below said first conduit means in use, and condensate outlet means for draining said hot fluid as condensate from said shell means, said condensate outlet means being located in said shell means and above said first conduit means in use, whereby said first conduit means is submersed in condensate in use, wherein said first conduit means and said vapor inlet means are substantially coextensive within said shell means.

7. The heat exchanger of claim 1, wherein said condensate outlet means is located in an uppermost wall portion of said shell means.

8. The heat exchanger of claim 6, wherein said vapor inlet means is an elongated manifold having vapor flow openings along its length.

9. The heat exchanger of claim 8, wherein said openings are directed for jet action mixing of condensate in said shell means in use.

10. The heat exchanger of claim 9, wherein said first conduit means is removably supported within said shell means.

11. A test heat exchanger for evaluating a process heat exchanger comprising:

first conduit means for conducting cooling fluid in use, shell means surrounding at least a portion of said first conduit means for conducting hot fluid in use, vapor inlet means for injecting hot fluid as steam into said shell means, said vapor inlet means being located within said shell means and below said first conduit means in use, and condensate outlet means for draining said hot fluid as condensate from said shell means, and condensate outlet means being located in said shell means and above said first conduit means in use, whereby said first conduit means is submersed in condensate in use, wherein said condensate outlet means is provided with valve means to control the flow of said hot fluid from said shell means, and wherein said first conduit means is removably mounted within said shell means and is made of the same metal as cooling fluid conduit means of the heat exchanger being evaluated.

12. The heat exchanger of claim 11, wherein said condensate outlet means is located in an uppermost wall portion of said shell means.

13. The test heat exchanger of claim 11, wherein said first conduit means includes removable test specimen means.

14. The test heat exchanger of claim 11, wherein said first conduit means is removably supported within said shell means by screw means.

15. The test heat exchanger of claim 14, wherein said first conduit means includes removable test specimen means.

16. The heat exchanger of claim 11, wherein said vapor inlet means is an elongated manifold having vapor flow openings along its length.

17. The heat exchanger of claim 16, wherein said openings are directed for jet action mixing of condensate in said shell means in use.

18. The heat exchanger of claim 11, wherein said first conduit means and said vapor inlet means are coextensive within said shell means.

19. The heat exchanger of claim 18, wherein said vapor inlet means is an elongated manifold having vapor flow openings along its length.

20. The heat exchanger of claim 19, wherein said openings are directed for jet action mixing of condensate in said shell means in use.

21. The heat exchanger of claim 20, wherein said first conduit means is removably supported within said shell means by screw means.

22. The heat exchanger of claim 21, wherein said first conduit means includes removable test specimen means.

23. The heat exchanger of claim 22, wherein said condensate outlet means is located in an uppermost wall portion of said shell means.

* * * * *